US010062960B2

(12) United States Patent
Goto

(10) Patent No.: US 10,062,960 B2
(45) Date of Patent: Aug. 28, 2018

(54) ANTENNA ELEMENT, ANTENNA DEVICE, AND WIRELESS COMMUNICATION EQUIPMENT USING THE SAME

(71) Applicant: TDK Corporation, Tokyo (JP)

(72) Inventor: Tetsuzo Goto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 262 days.

(21) Appl. No.: 14/963,105

(22) Filed: Dec. 8, 2015

(65) Prior Publication Data

US 2016/0181698 A1 Jun. 23, 2016

(30) Foreign Application Priority Data

Dec. 17, 2014 (JP) ..... 2014-254714

(51) Int. Cl.
*H01Q 1/36* (2006.01)
*H01Q 5/35* (2015.01)
*H01Q 1/24* (2006.01)

(52) U.S. Cl.
CPC ..... *H01Q 1/362* (2013.01); *H01Q 5/35* (2015.01); *H01Q 1/243* (2013.01)

(58) Field of Classification Search
CPC ..... H01Q 1/362; H01Q 7/00; H01Q 5/335; H01Q 5/371; H01Q 1/243; H01Q 9/0407
See application file for complete search history.

(56) References Cited

U.S. PATENT DOCUMENTS 6,028,568 A * 2/2000 Asakura ..... H01Q 1/362 343/700 MS
2002/0121957 A1* 9/2002 Takashima ..... H01F 17/0013 336/200
2003/0016177 A1* 1/2003 Deguchi ..... H01Q 1/242 343/702
2003/0169209 A1* 9/2003 Ohara ..... H01Q 1/242 343/895
2005/0184910 A1* 8/2005 Yamaguchi ..... H01Q 1/243 343/700 MS
2010/0007437 A1* 1/2010 Taniguchi ..... H03H 7/09 333/175
2010/0109829 A1* 5/2010 Sugiyama ..... H01F 17/0013 336/200

(Continued)

FOREIGN PATENT DOCUMENTS

JP 2005045103 A 2/2005
JP 2004-186730 4/2007

*Primary Examiner* — Dameon E Levi
*Assistant Examiner* — Jennifer F Hu
(74) *Attorney, Agent, or Firm* — Young Law Firm, P.C.

(57) ABSTRACT

An antenna element is provided with a substrate made of a dielectric body, first to third terminal electrodes formed on a bottom surface of the substrate, a helical coil pattern that is formed in the inside of the substrate, a first lead pattern connected to one end of the helical coil pattern or near the one end, a second lead pattern connected to the other end of the helical coil pattern or near the other end, a first through-hole conductor that connects the first terminal electrode and the first lead pattern, a second through-hole conductor that connects the second terminal electrode and the second lead pattern, and a third through-hole conductor that connects the third terminal electrode and the one end of the helical coil pattern.

9 Claims, 6 Drawing Sheets

(56) References Cited

U.S. PATENT DOCUMENTS

| | | | | |
|---|---|---|---|---|
| 2013/0265207 | A1* | 10/2013 | Yukimoto | H01Q 1/243<br>343/860 |
| 2014/0014733 | A1* | 1/2014 | Kato | H04B 5/0075<br>235/492 |
| 2015/0061951 | A1* | 3/2015 | Wong | H01Q 1/243<br>343/749 |

* cited by examiner

ANTENNA ELEMENT, ANTENNA DEVICE, AND WIRELESS COMMUNICATION EQUIPMENT USING THE SAME

BACKGROUND OF THE INVENTION

Field of the Invention

The present invention relates to an antenna element, and, in particular, to a structure of a surface-mount multi-resonant antenna element. The present invention also relates to an antenna device using the antenna element, and wireless communication equipment using the antenna device.

Description of Related Art

In recent years, a wireless mobile terminal, such as a cellular telephone, has many functions, such as a global positioning system (GPS), Bluetooth (registered trademark), and a wireless LAN, and becomes multi-functional for communication. With a wireless mobile terminal having multiple functions for communication, need for a multi-resonant antenna has been increasing. In general, a multi-resonant antenna can constitute dual bands or multiple bands antenna by using a plurality of radiation conductors having different antenna lengths. For example, Japanese Patent Application Laid-Open No. 2004-186730 discloses a multi-resonant antenna, in which a radiation conductor on a high frequency side and a radiation conductor on a low frequency side are connected to an inductor element having a meander pattern.

Although not being so small as compared to a linear antenna, a conventional multi-resonant antenna can contribute to reduction in size as an antenna for a wireless mobile terminal as large as a cellular telephone. However, since the conventional multi-resonant antenna is too large for even smaller equipment, such as wearable equipment which is available in recent years, further reduction in size has been demanded.

SUMMARY

Accordingly, an object of the present invention is to provide a multi-resonant antenna element that can be further reduced in size while a desired antenna characteristic is secured. Another object of the present invention is to provide a small and high-performance antenna device configured by using the antenna element and wireless communication equipment using the antenna device.

To achieve the above object, an antenna element according to the present invention includes a substrate made of a dielectric body having a substantially rectangular parallelepiped shape, first and second terminal electrodes formed on one end and the other end in a longitudinal direction of a bottom surface of the substrate, a third terminal electrode formed on the bottom surface of the substrate and disposed between the first and second terminal electrodes, a helical coil pattern that has a coil axis orthogonal to the bottom surface of the substrate and is formed inside of the substrate, a first lead pattern connected to one end of the helical coil pattern or a first intermediate point deviated from the one end to the other end, a second lead pattern connected to the other end of the helical coil pattern or a second intermediate point deviated from the other end to the one end, a first through-hole conductor connected between the first terminal electrode and the first lead pattern, a second through-hole conductor connected between the second terminal electrode and the second lead pattern, and a third through-hole conductor connected between the third terminal electrode and the one end of the helical coil pattern.

According to the present invention, an extremely small helical coil pattern having a large inductance value is formed in the inside of the substrate made of a dielectric body. Accordingly, the antenna element of the present invention can be reduced in size while inductance is secured as compared with a conventional antenna element using a meander pattern and the like. There can also be provided an antenna element having a three-terminal structure. By connecting a radiation conductor for a high-frequency antenna and a radiation conductor for a low-frequency antenna to the first and second terminal electrodes of the antenna element, and feeding power to the third terminal electrode, a small and high-performance multi-resonant antenna can be obtained.

In the present invention, the third terminal electrode is preferably made up of a set of a plurality of divided electrodes. According to the configuration, a magnetic path of a magnetic flux interlinked with the helical coil pattern is not interfered with by the third terminal electrode. Accordingly, inductance of the helical coil pattern can be made large, and an antenna characteristic can be improved.

The antenna element according to the present invention includes a ring pattern formed in the inside of the substrate and disposed above the third terminal electrode, and a plurality of fourth through-hole conductors that connect the ring pattern with the plurality of divided electrodes, and the third through-hole conductor is preferably connected the ring pattern. According to the configuration, the magnetic path of the magnetic flux interlinked with the helical coil pattern is not interfered with by a conductor pattern for short-circuiting the plurality of divided electrodes in the inside of the substrate. Accordingly, inductance of the helical coil pattern can be made large, and an antenna characteristic can be improved.

In the present invention, the helical coil pattern is preferably disposed above a half height of the substrate. By disposing the helical coil pattern at a position sufficiently higher than a mounting surface, inductance of the helical coil pattern can be made large while an influence of a ground pattern on the printed circuit board is restricted, and a small and high-performance multi-resonant antenna can be obtained.

In the present invention, the helical coil pattern preferably has a corner chamfered into a round shape. According to the configuration, an electrode pattern that is formed by printing can be printed as designed without being influenced by blurring of the printing, and variations in electric characteristics can be restricted. Accordingly, a highly-reliable multi-resonant antenna can be obtained.

The antenna device according to the present invention includes an antenna element and a printed circuit board on which the antenna element is mounted. The antenna element includes a substrate made of a dielectric body having a substantially rectangular parallelepiped shape, first and second terminal electrodes formed on one end and the other end in a longitudinal direction of a bottom surface of the substrate, a third terminal electrode formed on the bottom surface of the substrate and disposed between the first and second terminal electrodes, a helical coil pattern that has a coil axis orthogonal to the bottom surface of the substrate and is formed inside of the substrate, a first lead pattern connected to one end of the helical coil pattern or a first intermediate point deviated from the one end to the other end, a second lead pattern connected to the other end of the helical coil pattern or a second intermediate point deviated from the other end to the one end, a first through-hole conductor connected between the first terminal electrode and the first lead pattern, a second through-hole conductor connected between the second terminal electrode and the second lead pattern, and a third through-hole conductor connected between the third terminal electrode and the one end of the helical coil pattern. The printed circuit board is formed on a main surface on which the antenna element is mounted, and includes first and second radiation conductors connected to the first and second terminal electrodes, respectively, and a feed line that is formed on the main surface and connected to the third terminal electrode. A length of the second radiation conductor is larger than that of the first radiation conductor.

According to the present invention, an extremely small helical coil pattern having a large inductance value is formed in the inside of the substrate made of a dielectric body. Accordingly, the antenna element can be reduced in size while inductance is secured as compared with a conventional antenna element using a meander pattern and the like. A radiation conductor for a high-frequency antenna and a radiation conductor for a low-frequency antenna are connected to a small antenna element having a three-terminal structure, and the radiation conductors are connected to a feed line through the antenna element. Accordingly, desired radiation efficiency can be obtained even when a comparatively small printed circuit board is used. Accordingly, a small and high-performance multi-resonant antenna can be obtained.

In the present invention, the antenna element is mounted in a ground clearance area provided in a corner of the printed circuit board, and the first and second radiation conductors are preferably formed in the ground clearance area. According to the configuration, since there is free space in two directions viewed from the antenna element, radiation efficiency of the antenna can be improved.

In the present invention, the ground clearance area is in contact with both a first edge of the printed circuit board parallel to a first direction and a second edge of the printed circuit board parallel to a second direction. The first and second radiation conductors extend in parallel with the first edge from a mounting position of the antenna element toward the second edge, and the first radiation conductor is preferably disposed closer to the first edge than the second radiation conductor. According to the configuration, a high-frequency antenna can be disposed on an edge side of the printed circuit board, and an antenna characteristic of the high-frequency antenna that is more easily influenced by a ground pattern on the printed circuit board than the low-frequency antenna can be improved.

In the present invention, the second radiation conductor has a section that overlaps with an auxiliary radiation conductor formed on a back surface of the printed circuit board in a plan view, and the second radiation conductor is preferably connected to the auxiliary radiation conductor through a fourth through-hole conductor that penetrate through the printed circuit board. According to the configuration, radiation efficiency of a low frequency antenna can be improved by making an apparent size of the antenna as large as possible.

In the present invention, the printed circuit board is formed on the main surface, and a third radiation conductor connected to the third terminal electrode of the antenna element is preferably further included. According to the configuration, a small and high-performance triple-band antenna can be obtained.

Wireless communication equipment according to the present invention includes an antenna device having the above characteristics. According to the present invention, there can be provided small and high-performance wireless communication equipment mounted with a multi-resonant antenna.

According to the present invention, a small and high-performance multi-resonant antenna element can be provided. According to the present invention, a small and high-performance antenna device configured by using such an antenna element and wireless communication equipment using such an antenna device can also be provided.

BRIEF DESCRIPTION OF THE DRAWINGS

The above and other objects, features and advantages of this invention will become more apparent by reference to the following detailed description of the invention taken in conjunction with the accompanying drawings.

DETAILED DESCRIPTION OF THE EMBODIMENTS

Preferred embodiments of the present invention will now be described in detail with reference to the accompanying drawings.

Figure 1:
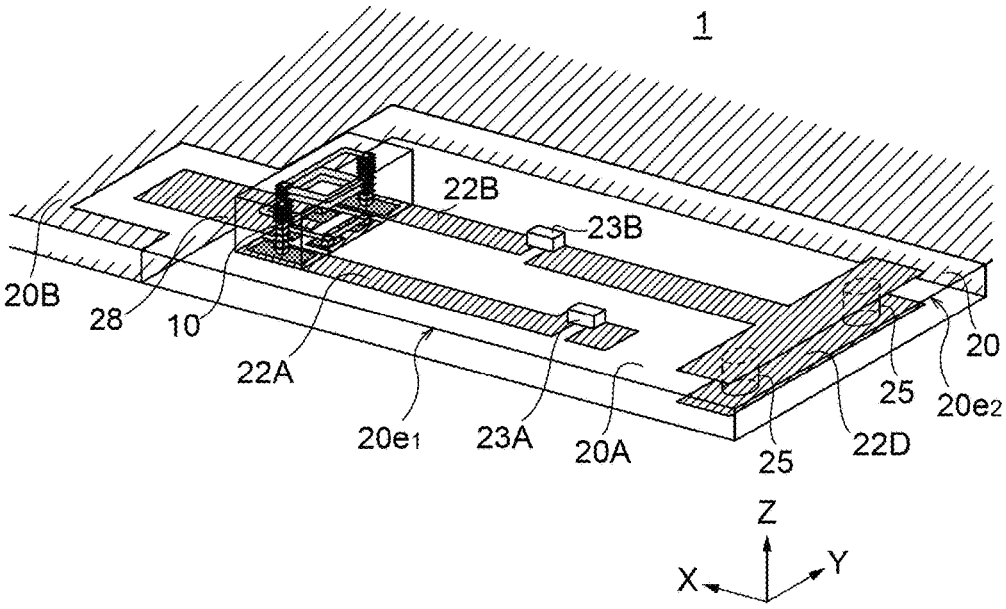
FIG. 1 is a schematic perspective view showing a configuration of an antenna device according to a first embodiment of the present invention.

FIG. 1 is a schematic perspective view showing a configuration of an antenna device according to a first embodiment of the present invention.

As shown in FIG. 1, the antenna device 1 is a multi-resonant antenna, and includes an antenna element 10 and a printed circuit board 20 on which the antenna element 10 is mounted.

The antenna element 10 is mounted in an antenna mounting area 20A provided on one main surface (top surface) of the printed circuit board 20. The antenna mounting area 20A is a ground clearance area from which a ground pattern is substantially excluded, and provided in a corner of the printed circuit board 20. When the antenna mounting area 20A is provided in a corner of the printed circuit board 20, there is free space in two directions viewed from the antenna element 10, and radiation efficiency of an antenna can be improved.

In the antenna mounting area 20A, there are formed a first radiation conductor 22A functioning as a high-frequency antenna and a second radiation conductor 22B functioning as a low-frequency antenna. When the antenna device 1 is, for example, a dual-band antenna for wireless LAN, a resonance frequency of the high-frequency antenna is set to 5 GHz, and a resonance frequency of the low-frequency antenna is set to 2.4 GHz.

The first radiation conductor 22A is a strip conductor that extends in an X direction from a mounting position of the antenna element 10. A frequency adjustment element 23A is serially inserted in a section around a front end of the first radiation conductor 22A. By widening a line width of a front end section of the first radiation conductor 22A, radiation efficiency of the high-frequency antenna can be improved. The front end of the first radiation conductor 22A is open.

The second radiation conductor 22B is a strip conductor longer than the first radiation conductor 22A. The second radiation conductor 22B has a T-shaped pattern, in which the second radiation conductor 22B similarly extends in the X direction from the mounting position of the antenna element 10 and then has a front end section branched into two in a Y direction. A frequency adjustment element 23B is serially inserted in the second radiation conductor 22B. By widening a line width of the front end section of the second radiation conductor 22B, radiation efficiency of the low-frequency antenna can be improved. The front end of the second radiation conductor 22B is open.

The second radiation conductor 22B is formed in the same plane with the first radiation conductor 22A, and both of the conductors do not overlap with each other. The front end section extending in the Y direction of the second radiation conductor 22B overlaps with an auxiliary radiation conductor 22D formed on a back surface of the printed circuit board 20 in a plan view, and the second radiation conductor 22B is connected to the auxiliary radiation conductor 22D through a through-hole conductor 25 that penetrate through the printed circuit board 20. By this configuration, an apparent size of the low-frequency antenna can be made as large as possible and radiation efficiency of the low-frequency antenna can be improved.

A large part of the printed circuit board 20 outside the antenna mounting area 20A is a main circuit area 20B on which a circuit necessary for constituting wireless communication equipment is mounted. A ground pattern is provided in a certain position in the main circuit area 20B. In the main circuit area 20B of the printed circuit board 20, there are mounted circuits and components necessary for constituting wireless communication equipment, such as a radio circuit, a controller, an interface circuit, a display, and a battery. A feed line 28 led from the main circuit area 20B into the antenna mounting area 20A is connected to the antenna element 10.

The antenna device 1 according to the present embodiment performs antenna operation in cooperation with a radiation conductor and a ground pattern on the printed circuit board 20, rather than performing antenna operation only with the antenna element 10. In this respect, the antenna element 10 can be considered as an impedance matching element that controls impedance of an entire antenna including the printed circuit board 20.

Figure 2:
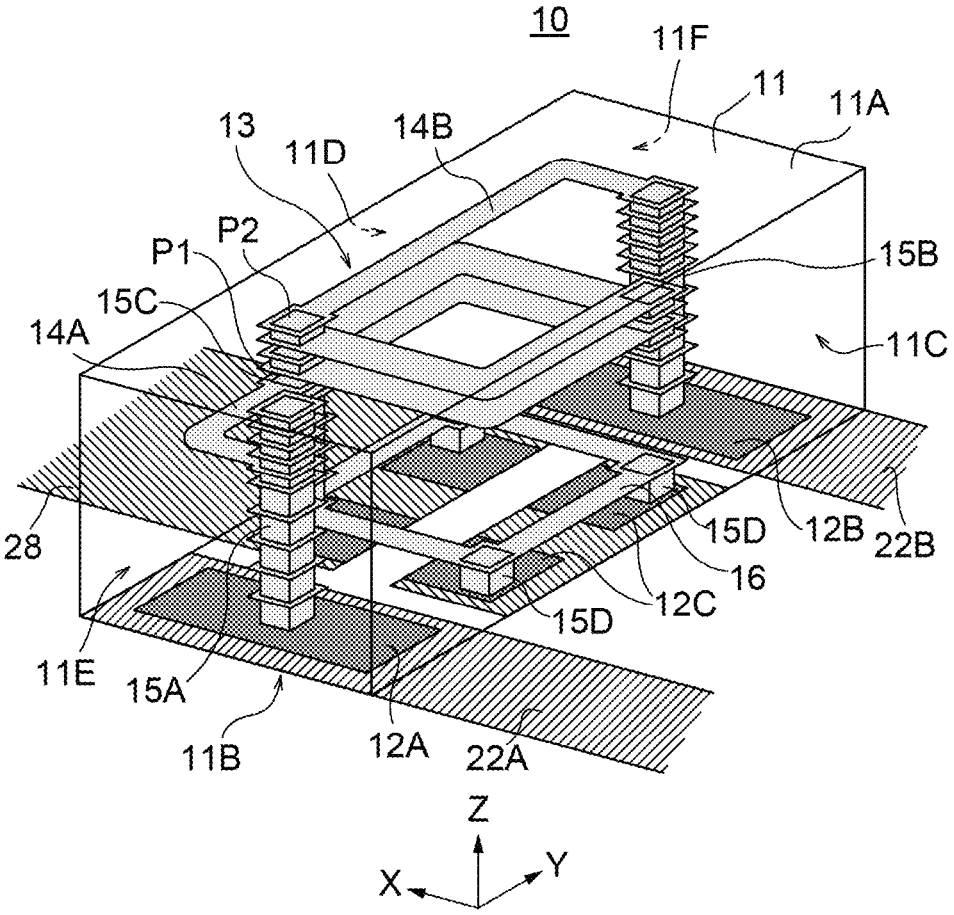
FIG. 2 is a schematic perspective view showing a configuration of the antenna element in detail.

FIG. 2 is a schematic perspective view showing a configuration of the antenna element 10 in detail.

As shown in FIG. 2, the antenna element 10 includes a substrate 11 made of a dielectric body (dielectric laminated block), and a plurality of electrode layers (electrode patterns) formed in the inside of the substrate 11. A shape of the substrate 11 is substantially rectangular parallelepiped, and the substrate 11 has a top surface 11A, a bottom surface 11B, and four side surfaces 11C to 11F. Among them, two side surfaces 11C and 11D are parallel to a longitudinal direction of the substrate 11, and the other two side surfaces 11E and 11F are orthogonal to a longitudinal direction of the substrate 11. A vertical direction of the antenna element 10 is defined by using a main surface of the printed circuit board 20 as a reference surface, and the bottom surface 11B of the substrate 11 is a surface (mounting surface) in contact with the printed circuit board 20 when mounted. Size of the substrate 11 is, for example, 1.6×0.8×0.4 (mm).

Although not specifically limited, low temperature co-fired ceramic (LTCC) is preferably used for a material of the substrate 11. Since LTCC can be low-temperature fired at 1000° C. or lower, low-melting-point metal materials, such as Ag and Cu, which have a low electric resistance and are excellent in a high-frequency characteristic, can be used as an internal electrode, by which an electrode pattern having a small resistance loss can be obtained. Since an electrode pattern can be formed in an inner layer of a multi-layer structure, an LC circuit can be reduced in size and have high performance. There is also a feature that dielectric sheets having different relative dielectric constants can be laminated and co-fired.

While first to third terminal electrodes 12A to 12C are provided on the bottom surface 11B of the substrate 11, no electrode pattern is provided on the top surface 11A and the four side surfaces 11C to 11F. That is, no radiation electrode is provided on an exposed surface of the substrate 11. Instead of a radiation electrode, a direction mark showing a direction of mounting of the antenna element may be formed on the exposed surface of the substrate 11. In this case, the direction mark is preferably formed on the top surface 11A of the substrate 11.

The first and second terminal electrodes 12A and 12B are formed on one end and the other end in a longitudinal direction of the bottom surface 11B, respectively. The third terminal electrode 12C is formed in a substantially center section in a longitudinal direction of the bottom surface 11B. As will be described in detail later, the third terminal electrode 12C is made up of a set of four divided electrodes, and functions electrically as a single terminal electrode by being short-circuited in the inside of the substrate 11. A planar layout of the first to third terminal electrodes 12A to 12C is preferably symmetric (rotationally symmetric and line-symmetric).

The first and second terminal electrodes 12A and 12B of the antenna element 10 mounted on the printed circuit board 20 are connected to the first and second radiation conductors 22A and 22B, respectively. The third terminal electrode 12C is connected to the feed line 28.

The substrate 11 includes a helical coil pattern 13, first and second lead patterns 14A and 14B, a first through-hole conductor 15A that connects the first lead pattern 14A and the first terminal electrode 12A, a second through-hole conductor 15B that connects the second lead pattern 14B and the second terminal electrode 12B, a third through-hole conductor 15C that connects one end P1 of the helical coil pattern 13 and the third terminal electrode 12C, a ring pattern 16 disposed above the third terminal electrode 12C, and a plurality of fourth through-hole conductors 15D that connect the ring pattern 16 to the plurality of divided electrodes constituting the third terminal electrode 12C.

The helical coil pattern 13 is made up of a combination of a plurality of L-shaped patterns (or C-shaped patterns) and a plurality of through-hole conductors, and has a coil axis orthogonal to a mounting surface. In the present embodiment, one end of the first lead pattern 14A is connected to the one end P1 (lower end), and one end of the second lead pattern 14B is connected to the other end P2 (upper end) of the helical coil pattern 13.

The one end of the first lead pattern 14A may be connected to a first intermediate point which is deviated from the one end P1 to the other end P2 of the helical coil pattern 13. The one end of the second lead pattern 14B may be connected to a second intermediate point which is deviated from the other end P2 to the one end P1. The first intermediate point is closer to the one end P1 than the other end P2. The second intermediate point is closer to the other end P2 than the one end P1. The intermediate points mentioned above do not mean a middle point at which a distance from the one end P1 and a distance from the other end P2 on the helical coil pattern 13 are equal, but mean a point between the one end P1 and the second point P2. The connection point of the one end of the first lead pattern 14A is set as appropriate in accordance with a resonance frequency of a high-frequency antenna, and the like, and the connection point of the one end of the second lead pattern 14B is set as appropriate in accordance with a resonance frequency of a low-frequency antenna, and the like.

In the present embodiment, the first radiation conductor 22A is connected to the feed line 28 without going through the helical coil pattern 13. Between the first radiation conductor 22A and the feed line 28, there exist inductance components, such as the first lead pattern 14A and the ring pattern 16, and these inductance components have appropriate inductance with respect to a resonance frequency of the high-frequency antenna. Accordingly, a multi-resonant antenna can be obtained without any particular problem.

The helical coil pattern 13 is preferably disposed above a half height of the substrate 11. In this manner, inductance of the helical coil pattern 13 can be made large by suppressing influence of a ground pattern on the printed circuit board 20, and a small and high-performance antenna element 10 can be provided. An apparent size of an antenna can also be made large, and radiation efficiency of the antenna can be improved.

As described above, the third terminal electrode 12C is made up of a set of the four divided electrode which are insulated and separated from each other, and the third through-hole conductor 15C is connected to one of the divided electrodes arranged close to the first terminal electrode 12A. The ring pattern 16 formed in the inside of the substrate 11 is disposed above the third terminal electrode 12C, and each of the four divided electrodes is connected to the ring pattern 16 through corresponding one of the fourth through-hole conductors 15D. However, for the divided electrode connected to the third through-hole conductor 15C, part (a lowermost section) of the third through-hole conductor 15C also functions as the fourth through-hole conductor 15D, and the divided electrode is connected to the ring pattern 16 through the third through-hole conductor 15C.

If the third terminal electrode 12C is a single large electrode, a magnetic path of a magnetic flux penetrating through a hollow section of the helical coil pattern 13 is blocked by the third terminal electrode 12C, and inductance of the helical coil pattern 13 is lowered. However, if the third terminal electrode 12C is made up of the divided electrodes, the magnetic path of the magnetic flux can be secured. Similarly, the ring pattern 16 can also play a role for securing the magnetic path of the magnetic flux generated by the helical coil pattern 13.

As described above, the antenna element 10 according to the present embodiment can be considered as an inductive coupled device, in which the first and second radiation conductors 22A and 22B and the feed line 28 are connected through the helical coil pattern 13.

Figure 3:
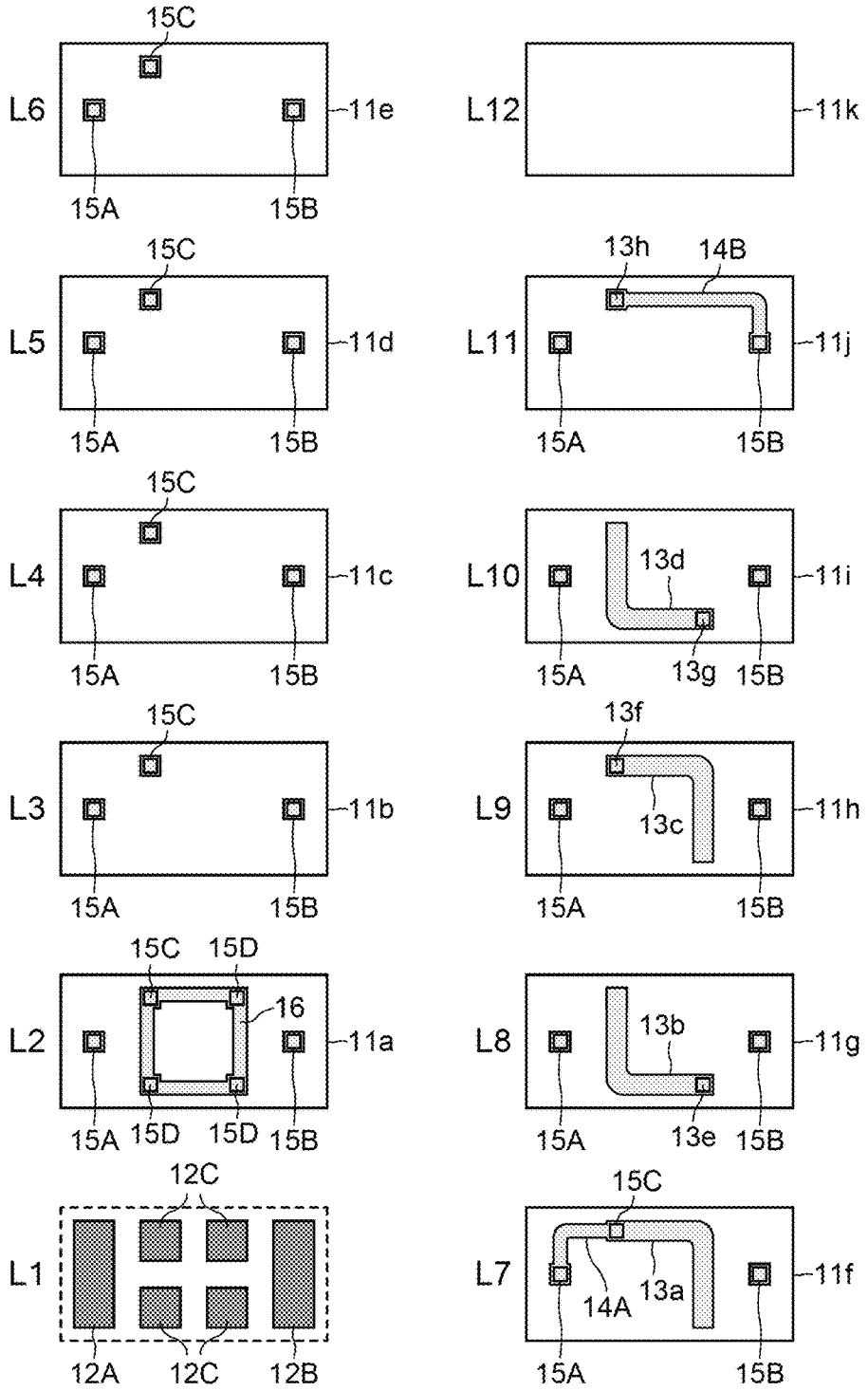
FIG. 3 is a plan view showing a pattern layout of each electrode layer of the antenna element.

FIG. 3 is a plan view showing a pattern layout of each electrode layer of the antenna element 10.

As shown in FIG. 3, the antenna element 10 according to the present embodiment is obtained by laminating a large number of dielectric layers (dielectric sheets). A top surface of each of the dielectric layers and a bottom surface of the bottom dielectric layer are electrode pattern formation surfaces. Although not specifically limited, the antenna element 10 according to the present embodiment includes eleven layers in total of the dielectric layers, 11*a* to 11*k*, and first to twelve electrode layers L1 to L12. The first electrode layer L1 is formed on a bottom surface of the bottom dielectric layer 11*a*, and the second electrode layer L2 to the twelfth electrode layer L12 are formed on top surfaces of the corresponding dielectric layers 11*a* to 11*j*.

In the present embodiment, each thickness of the dielectric layers 11*a* to 11*f* is preferably larger than that of each of the dielectric layers 11*g* to 11*j* which are upper layers of the dielectric layers 11*a* to 11*f*. For example, each thickness of the dielectric layers 11*a* to 11*f* is set to 40 μm and each thickness of the dielectric layers 11*g* to 11*j* is set to 20 μm. By using the dielectric layers having two different types of thicknesses, a sufficient height from the bottom surface 11B of the substrate 11 up to the helical coil pattern 13 can be occupied by a small number of layers, and the helical coil pattern 13 can be formed to be thin.

The first to third terminal electrodes 12A to 12C are provided on the first electrode layer L1. As described above, the third terminal electrode 12C is made up of a set of four divided electrodes.

The ring pattern 16 having a rectangular shape is provided on the second electrode layer L2, and four corners of the ring pattern 16 are connected to the divided electrodes of the third terminal electrode 12C through the through-hole conductors 15D that penetrate through the dielectric layer 11*a*. On the third electrode layer L3 to the sixth electrode layer L6, only the first to third through-hole conductors 15A to 15C that penetrate through the dielectric layers 11*b* to 11*e* are provided, and no substantial electrode pattern is provided.

The first lead pattern 14A and a first L-shaped pattern 13*a* are provided on the seventh electrode layer L7, a second L-shaped pattern 13*b* is provided on the eighth electrode layer L8, a third L-shaped pattern 13*c* is provided on the ninth electrode layer L9, and a fourth L-shaped pattern 13*d* is provided on the tenth electrode layer L10. The second lead pattern 14B is provided on the eleventh electrode layer L11. End sections of the first to fourth L-shaped pattern 13*a* to 13*d* are continuously connected to each other through the through-hole conductors 13*e* to 13*h*, so that the helical coil pattern 13 is formed in one piece. The twelfth electrode layer 11*k* is a top surface of the substrate 11, and provided with no electrode pattern in the present embodiment. However, an electrode pattern may be provided as a direction mark as described above.

The first and second through-hole conductors 15A and 15B penetrate through the first to tenth dielectric layers 11*a* to 11*j*, and the third through-hole conductor 15C penetrates through the first dielectric layer 11*a* to the seventh dielectric layer 11*f*. On the seventh electrode layer L7, one end of the first L-shaped pattern 13*a* corresponding to the one end P1 of the helical coil pattern 13 is connected to an upper end of the third through-hole conductor 15C, and also connected to the first through-hole conductor 15A through the first lead pattern 14A. On the eleventh electrode layer L11, an upper end of the through-hole conductor 13*h* corresponding to the other end P2 of the helical coil pattern 13 is connected to the second through-hole conductor 15B through the second lead pattern 14B.

Corners of the first to fourth L-shaped patterns 13*a* to 13*d* constituting the helical coil pattern 13 and the first and second lead patterns 14A and 14B are preferably chamfered into a round shape. If the helical coil pattern 13 having corners at a right angle is formed by printing a conductive paste, there is possibility that printing accuracy of the pattern is lowered by blurring of printing, electric characteristic variations are generated, and an antenna characteristic is lowered. However, if the corners are chamfered into a round shape, the patterns can be printed just as designed, and electric characteristic variations can be restricted. Accordingly, a high-reliable multi-resonant antenna can be obtained.

Figure 4A:
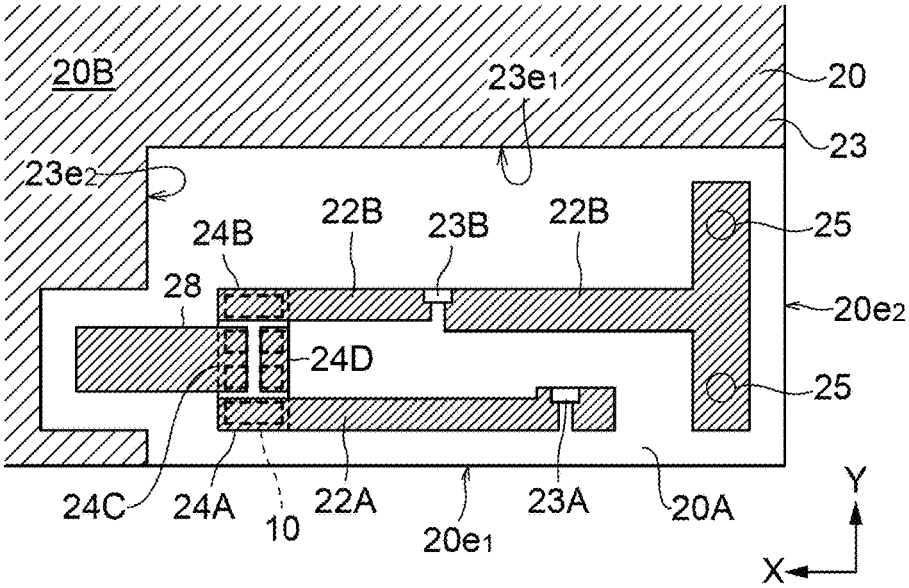
FIGS. 4A and 4B are schematic plan views showing a pattern layout of the antenna mounting area on the printed circuit board.
Figure 4B:
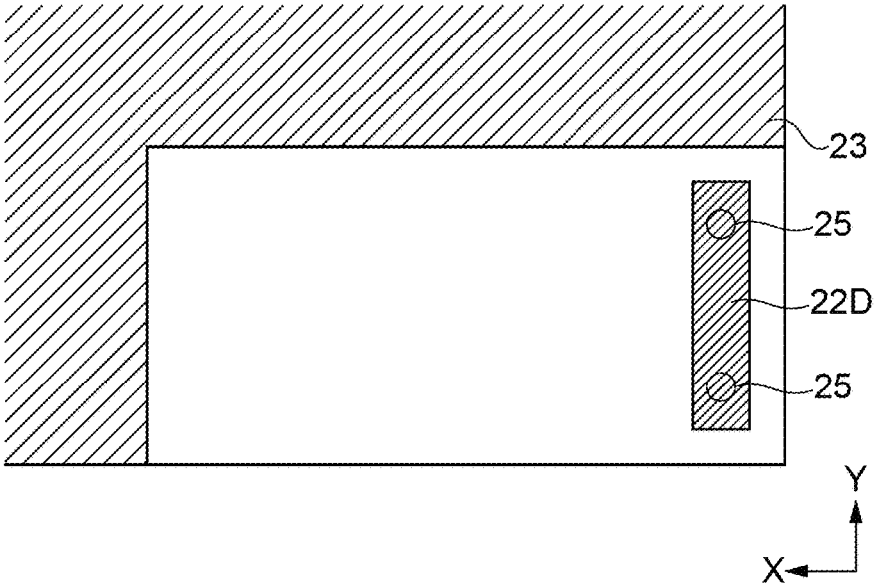

FIGS. 4A and 4B are schematic plan views showing a pattern layout of the antenna mounting area 20A on the printed circuit board 20. FIG. 4A shows a layout on a top surface of the printed circuit board 20, and FIG. 4B shows a layout of a back surface of the printed circuit board 20. FIG. 4B is a diagram showing the layout of the back surface viewed through the top surface of the printed circuit board 20.

As shown in FIGS. 4A and 4B, the printed circuit board 20 is obtained by forming a conductive pattern and a through-hole conductor on an insulated substrate 21, such as FR4. In particular, the antenna mounting area 20A is provided on the printed circuit board 20. As described above, the antenna mounting area 20A has a rectangular shape which is longer in an X direction. Size of the antenna mounting area 20A is, for example, 10×5 (mm).

The antenna mounting area 20A is enclosed by an edge of the printed circuit board 20 or a ground pattern 23 on the printed circuit board 20. An outer side of the antenna mounting area 20A is the main circuit area 20B on which circuits or components constituting wireless communication equipment are mounted. The ground pattern 23 for distinguishing a boundary between the antenna mounting area 20A and the main circuit area 20B is formed in the main circuit area 20B.

In the present embodiment, the antenna mounting area 20A is provided in a corner of the printed circuit board 20. For this reason, the antenna mounting area 20A is enclosed on two sides by edges 23$e_1$ and 23$e_2$ of the ground pattern on the printed circuit board 20, and on the remaining two sides by edges 20$e_1$ and 20$e_9$ of the printed circuit board 20. The edge 23$e_1$ and the edge 20$e_1$ are parallel to an X direction, and the edge 23$e_2$ and the edge 20$e_2$ are parallel to a Y direction. When the antenna mounting area 20A is provided in contact with the edges 20$e_1$ and 20$e_2$ of the printed circuit board 20 as described above, space in two directions viewed from the antenna element 10 is free space where the printed circuit board (ground pattern) does not exist, thereby radiation efficiency of the antenna can be improved. An effect of placing the antenna mounting area 20A in a corner of the printed circuit board 20 is shown significantly in small wireless communication equipment in which a length of a longer side of the printed circuit board 20 is 50 mm or smaller.

A large part of the antenna mounting area 20A is a ground clearance area where a ground pattern is excluded. As also shown in FIG. 1, the ground clearance area is provided not only on a top surface of the printed circuit board 20 but also on a back surface, and also provided in an inner layer for a multi-layer substrate. That is, space in which a ground pattern is excluded extends immediately below the antenna mounting area 20A. By using the antenna mounting area 20A as a ground clearance area, an antenna characteristic can be stabilized, and radiation efficiency of the antenna element 10 can be improved.

As illustrated, four lands 24A, 24B, 24C, and 24D are provided in the antenna mounting area 20A. A first radiation conductor 22A is connected to the land 24A, and a second radiation conductor 22B is connected to the land 24B. The feed line 28 pulled from the main circuit area 20B into the antenna mounting area 20A is connected to the land 24C. When the antenna element 10 is mounted, the first and second terminal electrodes 12A and 12B of the antenna element 10 are connected to the lands 24A and 24B, respectively, and the third terminal electrode 12C of the antenna element 10 is connected to both the lands 24C and 24D.

The first and second radiation conductors 22A and 22B extend from a mounting position of the antenna element 10 toward the edge 20$e_1$ of the printed circuit board 20 in parallel to the edge 20$e_1$. The first radiation conductor 22A is arranged closer to the edge 20$e_1$ of the printed circuit board 20 than the second radiation conductor 22B in the antenna mounting area 20A. By providing a high-frequency antenna closer to the edge 20$e_1$ of the printed circuit board 20, a bandwidth of the high-frequency antenna that tends to be narrower than a bandwidth of a low-frequency antenna can be widened.

As described above, since a minute helical coil pattern is formed in the inside of a dielectric chip, the antenna element 10 according to the present embodiment can be reduced in size while inductance is secured, as compared to a conventional antenna element using a meander pattern. Since the radiation conductor 22A for a high-frequency antenna and the radiation conductor 22B for a low-frequency antenna are connected to the small antenna element 10 having a three-terminal structure, and the radiation conductors 22A and 22B are connected to the feed line 28 through the antenna element 10, desired radiation efficiency can be obtained even by using the printed circuit board 20 which is comparatively small. Accordingly, a small and high-performance multi-resonant antenna can be obtained.

In the present embodiment, although the first radiation conductor 22A is connected to the feed line without using the helical coil pattern 13, inductance components exist and have appropriate inductance with respect to a resonance frequency of a high-frequency antenna. Accordingly, a multi-resonant antenna can be obtained without a problem.

Figure 5:
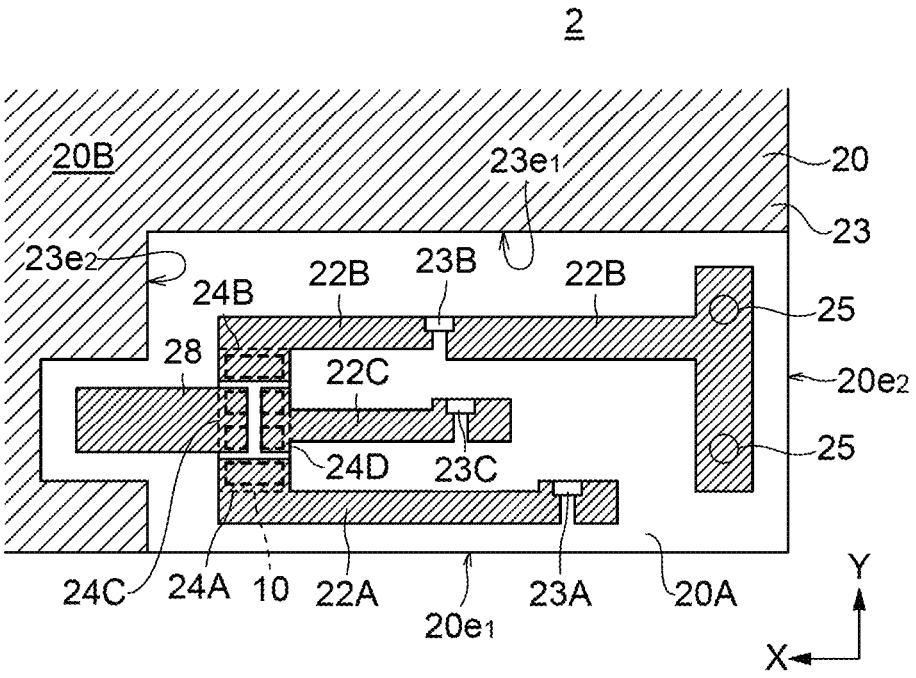
FIG. 5 is a schematic plan view showing a configuration of the antenna device according to a second embodiment of the present invention.

FIG. 5 is a schematic plan view showing a configuration of the antenna device according to a second embodiment of the present invention.

As shown in FIG. 5, it is characterized in that this antenna device 2 has the third radiation conductor 22C. The third radiation conductor 22C is a strip conductor that extends from the land 24D on the printed circuit board 20 in an X direction, and functions as an antenna on an even higher frequency side than the second radiation conductor 22B. A frequency adjustment element 23C is serially inserted in a section in the vicinity of a front end of the third radiation conductor 22C, so that a resonance frequency is fine-tuned. According to the present embodiment, a small and high-performance triple-band antenna having three resonance points can be obtained.

Figure 6:
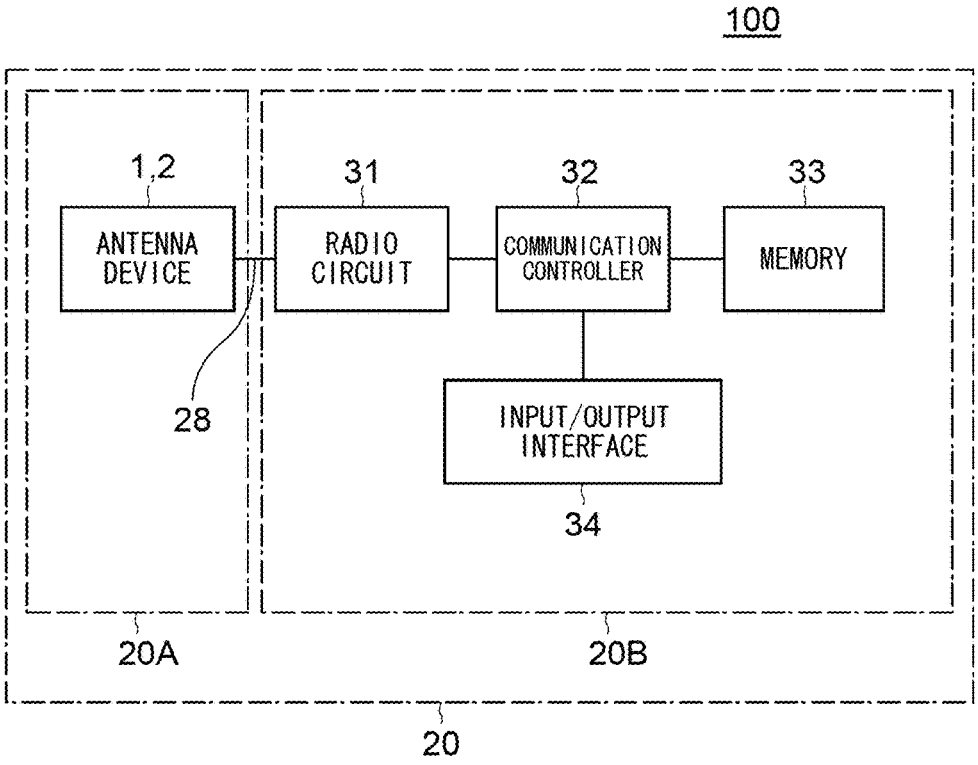
FIG. 6 is a block diagram showing an example of a configuration of wireless communication equipment using the antenna device according to the first or second embodiment.

FIG. 6 is a block diagram showing an example of a configuration of wireless communication equipment 100 using the antenna device 1 or 2.

As shown in FIG. 6, the wireless communication equipment 100 includes the antenna device 1 or 2, a radio circuit 31 connected to the antenna device 1 or 2 through the feed line 28, a communication controller 32 that controls the radio circuit 31, a memory 33, and an input and output interface 34. The antenna device 1 or 2 is provided in the antenna mounting area 20A of the printed circuit board 20, and the radio circuit 31, the communication controller 32, the memory 33, and the input and output interface 34 are provided in the main circuit area 20B of the printed circuit board 20.

The present invention has thus been shown and described with reference to specific embodiments. However, it should be noted that the present invention is not limited to the details of the described arrangements but changes and modifications may be made without departing from the scope of the appended claims.

For example, in the above embodiment, the third terminal electrode 12C is divided into four sections. However, the third terminal electrode 12C may be divided into a smaller or larger number of sections as long as passing of a magnetic flux is not blocked. The number of turns of the helical coil pattern 13 is not specifically limited, and may be any number of turns as long as a desired antenna characteristic can be obtained.

What is claimed is:

1. An antenna element comprising:

a substrate made of a dielectric body having a substantially rectangular parallelepiped shape;

first and second terminal electrodes formed on one end and the other end in a longitudinal direction of a bottom surface of the substrate;

a third terminal electrode formed on the bottom surface of the substrate and disposed between the first and second terminal electrodes, wherein the third terminal electrode comprises a plurality of divided electrodes;

a helical coil pattern that has a coil axis orthogonal to the bottom surface of the substrate and is formed inside of the substrate, wherein the helical coil has a first end and a second end;

a ring pattern formed inside of the substrate and disposed above the third terminal electrode;

a first lead pattern connected to the first end of the helical coil pattern or to a first intermediate point between the first end and the second end;

a second lead pattern connected to the second end of the helical coil pattern or to a second intermediate point between the first end and the second end;

a first through-hole conductor connected between the first terminal electrode and the first lead pattern;

a second through-hole conductor connected between the second terminal electrode and the second lead pattern;

a third through-hole conductor connected between the third terminal electrode and the first end of the helical coil pattern, wherein the third through-hole conductor is connected to the ring pattern; and a plurality of fourth through-hole conductors that connect the ring pattern with the plurality of divided electrodes.

2. The antenna element as claimed in claim 1, wherein the helical coil pattern is disposed above a half height of the substrate.

3. The antenna element as claimed in claim 1, wherein the helical coil pattern has a corner chamfered into a round shape.

4. An antenna device comprising:

an antenna element; and a printed circuit board having a main surface on which the antenna element is mounted, wherein the antenna element includes:

a substrate made of a dielectric body having a substantially rectangular parallelepiped shape;

first and second terminal electrodes formed on one end and the other end in a longitudinal direction of a bottom surface of the substrate;

a third terminal electrode formed on the bottom surface of the substrate and disposed between the first and second terminal electrodes;

a helical coil pattern that has a coil axis orthogonal to the bottom surface of the substrate and is formed inside of the substrate, wherein the helical coil has a first end and a second end;

a ring pattern formed inside of the substrate and disposed above the third terminal electrode;

a first lead pattern connected to the first end of the helical coil pattern or to a first intermediate point between the first end and the second end;

a second lead pattern connected to the second end of the helical coil pattern or to a second intermediate point between the first end and the second end;

a first through-hole conductor connected between the first terminal electrode and the first lead pattern;

a second through-hole conductor connected between the second terminal electrode and the second lead pattern; and a third through-hole conductor connected between the third terminal electrode and the first end of the helical coil pattern via the ring pattern, wherein the printed circuit board includes:

first and second radiation conductors that is formed on the main surface on which the antenna element is mounted and connected to the first and second terminal electrodes, respectively; and a feed line that is formed on the main surface and connected to the third terminal electrode, and wherein a length of the second radiation conductor is larger than that of the first radiation conductor.

5. The antenna device as claimed in claim 4, wherein the antenna element is mounted in a ground clearance area provided in a corner of the printed circuit board, and the first and second radiation conductors are formed in the ground clearance area.

6. The antenna device as claimed in claim 5, wherein the ground clearance area is in contact with both a first edge of the printed circuit board parallel to a first direction and a second edge of the printed circuit board parallel to a second direction, the first and second radiation conductors extend in parallel with the first edge from a mounting position of the antenna element toward the second edge, and the first radiation conductor is disposed closer to the first edge than the second radiation conductor.

7. The antenna device as claimed in claim 6, wherein the second radiation conductor has a section that overlaps with an auxiliary radiation conductor formed on a back surface of the printed circuit board in a plan view, and the second radiation conductor is connected to the auxiliary radiation conductor through a fourth through-hole conductor that penetrates through the printed circuit board.

8. The antenna device as claimed in claim 4, wherein the printed circuit board further includes a third radiation conductor formed on the main surface and connected to the third terminal electrode of the antenna element.

9. A wireless communication equipment including the antenna device as claimed in claim 4.

* * * * *